US007699152B2

(12) United States Patent
Kanno et al.

(10) Patent No.: US 7,699,152 B2
(45) Date of Patent: Apr. 20, 2010

(54) DEVICE FOR DISCRIMINATING VALUABLE PAPERS WITH LOW POWER CONSUMPTION

(75) Inventors: Noriyuki Kanno, Sagamihara (JP); Masahiro Motohara, Sagamihara (JP); Takeshi Mitsuma, Sagamihara (JP); Shinya Izawa, Osaka (JP)

(73) Assignee: Japan Cash Machine, Co., Ltd., Osaka (JP)

( * ) Notice: Subject to any disclaimer, the term of this patent is extended or adjusted under 35 U.S.C. 154(b) by 34 days.

(21) Appl. No.: 10/525,335

(22) PCT Filed: Aug. 22, 2003

(86) PCT No.: PCT/JP03/10626

§ 371 (c)(1),
(2), (4) Date: Sep. 19, 2005

(87) PCT Pub. No.: WO2004/019286

PCT Pub. Date: Mar. 4, 2004

(65) Prior Publication Data

US 2006/0108732 A1 May 25, 2006

(30) Foreign Application Priority Data

Aug. 22, 2002 (JP) ..... 2002-242438

(51) Int. Cl.
*G07F 7/04* (2006.01)

(52) U.S. Cl. ..... 194/206

(58) Field of Classification Search ..... 49/32, 49/35, 373; 902/17, 31; 194/205, 206, 207
See application file for complete search history.

(56) References Cited

U.S. PATENT DOCUMENTS

| | | | | |
|---|---|---|---|---|
| 3,266,060 | A * | 8/1966 | Springer | 4/213 |
| 3,971,464 | A * | 7/1976 | Seversen | 194/216 |
| 4,434,931 | A | 3/1984 | Hunt et al. | |
| 4,474,455 | A * | 10/1984 | Hirakura et al. | 399/128 |
| 4,662,621 | A * | 5/1987 | Lundblad | 271/3.19 |
| 4,784,274 | A * | 11/1988 | Mori et al. | 209/534 |
| 5,419,423 | A | 5/1995 | Ishida et al. | |
| 5,991,887 | A | 11/1999 | Ezell | |
| 6,227,343 | B1 | 5/2001 | Neathway et al. | |

(Continued)

FOREIGN PATENT DOCUMENTS

| | | |
|---|---|---|
| JP | 57-41765 | 3/1982 |

(Continued)

*Primary Examiner*—Patrick Mackey
*Assistant Examiner*—Mark Beauchaine
(74) *Attorney, Agent, or Firm*—Bachman & LaPointe, P.C.

(57) ABSTRACT

A device for discriminating valuable papers comprises a battery 1; a self-holding circuit 5 connected between battery 1 and drive controller 2 and capable of being switched between an active condition for supplying electric power to validation sensor 4 and drive controller 2 from battery 1 and an inactive condition for interrupting the power supply; a trigger element 6 for switching self-holding circuit 5 in the inactive condition to the active condition; and a shutoff circuit 7 having a control terminal connected to drive controller 2 for switching self-holding circuit 5 in the active condition to the inactive condition. Inactive condition of self-holding circuit 5 during the disuse period, saves electric power to extend service life and exchange cycle of battery 1.

8 Claims, 14 Drawing Sheets

U.S. PATENT DOCUMENTS 6,625,741 B1 * 9/2003 Post et al. ..... 713/340

FOREIGN PATENT DOCUMENTS

| | | | |
|---|---|---|---|
| JP | 6-176245 | | 6/1994 |
| JP | 7-160933 | | 6/1995 |
| JP | 2000-76413 | | 3/2000 |
| WO | WO 92/09057 | * | 5/1992 |
| WO | WO-92/09057 A1 | * | 5/1992 |

* cited by examiner

DEVICE FOR DISCRIMINATING VALUABLE PAPERS WITH LOW POWER CONSUMPTION

TECHNICAL FIELD

This invention relates to a device for discriminating valuable papers, in particular, of the type which can control consumption of power from a battery by automatically switching the device from the activating condition to the de-activating condition during the disuse period of time.

BACKGROUND OF THE INVENTION

Prior art bill validators have been used for various kinds of bill handling machines such as vending machines, money exchangers and bill dispensers installed all over the world. As shown in FIG. 12, a prior art bill validator comprises a conveyer 3 for transporting a bill inserted from an inlet 33 along a passageway 34 to a stand-by position 36; an inlet sensor 30 mounted at a front end of passageway 34 for detecting bill inserted into inlet 33; a validation sensor 4 for detecting optical or magnetic pattern of bill moving through passageway 34 to produce detection signals; a stacking device 41 for stowing bill moved to the stand-by position 36 into an accumulation chamber 44; and a drive controller 2 for receiving detection signals from validation sensor 4, validating authenticity of bill and providing conveyer 3 and stacking device 41 with drive signals. Validation sensor 4 includes a magnetic sensor 22 such as magnetic head or Hall element for discerning magnetic characteristics on bill transported along passageway 34, and an optical sensor 21 such as photo-coupler for discerning optical characteristics on or through bill. Drive controller 2 receives detection signals from validation sensor 4 and examines authenticity of bill and decides a genuine or false bill based on the received detection signals. Passageway 34 includes a generally horizontal validation path 34*a* connected to inlet 33 at one end thereof; an arcuate path 35 having an upper end connected to the opposite end of validation path 34*a* from inlet 33; and the stand-by position 36 connected to a lower end of arcuate path 35. Arcuate path 35 serves to divert passageway 34 substantially an angle of 180 degrees to transport bill to stand-by position 36 positioned under and in parallel to validation path 34*a*.

As shown in FIGS. 12 and 13, a convey stacker 43 comprises a convey motor 25; a pinion 70 mounted on an output shaft of convey motor 25; a first gear 71 in mesh with pinion 70; a second gear 72 mounted on a common rotation shaft for first gear 71; a third gear 73 engaged with second gear 72; a fourth gear 74 mounted on a common rotation shaft for third gear 73; a fifth gear 75 mating with fourth gear 74; a sixth gear 76 mounted on a common rotation shaft for fifth gear 75; a seventh gear 77 in engagement with sixth gear 76; a eighth gear 78 mounted on a common rotation shaft for seventh gear 77; a ninth gear 79 interlocking with eighth gear 78; a tenth gear 80 mounted on a common rotation shaft for ninth gear 79; and a eleventh gear 81 meshing with tenth gear 80. Eleventh gear 81 is mounted on a common rotation shaft for a convey roller 32 which is rotatable along arcuate path 35. As shown in FIG. 13, two rubber rings 32*a* are wound in parallel to each other around an outer cylindrical surface of convey roller 32 to transmit rotational force to bill through rubber rings 32*a* in order to smoothly convey bill along arcuate path 35.

As shown in FIG. 15, eleventh gear 81 is provided with a drive belt pulley 84, and a drive belt 83 is wound around drive belt pulley 84 and some idle belt pulleys. A driven belt pulley 84 is mounted on a common rotation shaft for a convey belt pulley 26 around which a belt 27 is wound.

As shown in FIG. 14, attached to tenth gear 80 is a crank plate 55 which supports a pin 56 secured in an eccentric position on crank plate 55 to rotatably connect one end of a connecting rod 57 to pin 56. The other end of connecting rod 57 is rotatably connected to a shaft 59 located in an elongated opening 58 formed on frame wall; shaft 59 is rotatably received in a hole formed at an end of a first link 60; and the other end of first link 60 is pivotally connected to a push plate 40 through a pin 61. A pin 62 rotatably connects each intermediate portion of first and second links 60 and 63; one end of second link 63 is rotatably attached to frame wall by a pin 64; the other end of second link 63 is rotatably and slidably attached to push plate 40. With rotation of crank plate 55, the other end of connecting rod 57 performs reciprocal movement together with shaft 59 within elongated opening 58; reciprocal movement of shaft 59 causes telescopic movement of first and second links 60 and 63 to move push plate 40 toward and away from accumulation chamber 44 of stacking device 41. Convey motor 25 is electrically connected to drive controller 2 which rotates convey motor 25 in the adverse direction to rotate crank plate 55 when drive controller 2 decides bill as genuine, and rotation of crank plate 55 causes extension of first and second links 60 and 63 to move push plate 40 downward and stow bill by push plate 40 into accumulation chamber 44 of stacking device 41. Not shown but, as crank plate 55 is mounted on tenth gear 80 through a unidirectional or one-way clutch, it is not rotated during the forward rotation of convey motor 25. Accordingly, only when convey motor 25 is rotated in the adverse direction, crank plate 55 is rotated to move push plate 40 between the original or retracted and extended positions.

Bill is transported to the stand-by position 36, and a holder 47 retained in the horizontal condition serves to temporarily support a rear end of bill substantially in the horizontal condition as shown by solid line in FIG. 12. Then, bill in the stand-by position 36 is put into accumulation chamber 44 of stacking device 41 when push plate 40 is moved downward. At that time, holder 47 is rotated downward by a rear end of bill put into accumulation chamber 44 so that rear end of bill is curved or deflected to override holder 47 and move under holder 47. In this way, pushed bill certainly is moved under holder 47 not to prevent entry of a next bill to the stand-by position 36 by the sticking rear end of stacked bill and to avoid jamming of bill by the next bill. Rotatably mounted is a lever 46 which is resiliently urged and retained to the horizontal position by a spring 49 so that passage of bill causes lever 46 to rotate against resilient force of tension spring 49 and allow passage of bill. Provided under convey device 3 is stacking device 41 for storing bills to sandwich the stand-by position 36 between convey device 3 and stacking device 41.

In operation of the bill validator, when bill is inserted into inlet 33, inlet sensor 30 detects bill to produce a detection signal to the drive controller 2. Then, convey motor 25 is rotated in the forward direction to drive convey belt 27 through drive belt 83 so that bill is inwardly transported along validation path 34*a*. At this time, validation sensor 4 converts magnetic and optical feature of bill into electric signals to drive controller 2 which then examines and decides a genuine or false bill based on the received detection signals. When drive controller 2 does not decide bill as genuine, it provides convey motor 25 with inverted signals in the way of conveyance to drive convey belt 27 in the adverse direction and thereby return bill from validation path 34*a* to inlet 33. On the contrary, when drive controller 2 decides bill as genuine, it continuously rotates convey motor 25 in the forward direction to transport bill along arcuate path 35 to the stand-by position 36. At the moment, both sides of bill are supported on a pair of opposite side ribs 37 shown in FIG. 16, and rear end of bill is supported on holder 47, but push plate 40 is kept in the original position above the stand-by position 36. Then, drive controller 2 rotates convey motor 25 in the adverse direction to rotate crank plate 55. This causes first and second links 60 and 63 to extend as shown in FIG. 14 so that push plate 40 is moved into accumulation chamber 44 of stacking device 41 to stow bill retained in the stand-by position 36 in accumulation chamber 44 of stacking device 41. When push plate 40 crams bill through an opening 39 formed between side ribs 37 into accumulation chamber 44, holder 47 is rotated downward from the horizontal position to a certain angle against elastic force of tension spring 49. When bill overrides and moves away from holder 47, it is returned to the original horizontal position by elastic force of tension spring 48. Thereafter, when convey motor 25 is rotated in the adverse direction to rotate crank plate 55 an angle of nearly 360 degrees, first and second links 60 and 63 are retracted to return push plate 40 from the stand-by position to the upper original position.

In this way, when bill in the stand-by position is squeezed downward into accumulation chamber 44, lever 46 is rotated downward by rear end of pushed bill, and rear end of bill is curved or deflected to pass over and move under lever 46. In that way, reliable stowage of pushed bill under lever 46 allows a next bill to smoothly enter the stand-by position 36 without barring entrance of subsequent bill into the stand-by position 36 by sticking out rear end of bill that results in jamming of the subsequent bill. FIG. 17 shows an appearance of the bill validator.

By the way, prior art bill validators are defective in consuming a large amount of electric power because they always require continuously running current even during the inoperative period of validators. Therefore, prior art bill validators are unavailable without commercial power supply. Otherwise, although batteries are provided in validators, more frequently batteries have to be exchanged for new ones or charged due to the large consumption power, and therefore, a bill validator of power saving type has still been required.

An object of the present invention is to provide a device for discriminating valuable papers capable of reducing power consumption by automatically switching it from the active to the inactive condition during the inoperative period.

SUMMARY OF THE INVENTION

The device for discriminating valuable papers according to the present invention comprises a conveyer (3) for transporting a valuable paper inserted from an inlet (33) along a passageway (34) to a stand-by position (36) of passageway (34); a validation sensor (4) for detecting optical or magnetic pattern of the paper moving through the passageway (34) to produce detection signals; a stacking device (41) for stowing the paper moved to the stand-by position (36) by the conveyer (3) into an accumulation chamber (44); and a drive controller (2) for receiving detection signals from validation sensor (4), validating authenticity of bill and providing conveyer (3) and stacking device (41) with drive signals. The discriminating device further comprises a battery (1); a self-holding circuit (5) connected between battery (1) and drive controller (2) and capable of being switched between an active or activation condition for supplying electric power to validation sensor (4), drive controller (2) and conveyer (3) from battery (1) and an inactive or deactivation condition for interrupting the power supply; a trigger element (6) for switching self-holding circuit (5) in the inactive condition to the active condition; and a shutoff circuit (7) having a control terminal connected to drive controller (2) for switching self-holding circuit (5) in the active condition to the inactive condition. When trigger element (6) is turned on, self-holding circuit (5) is switched from the inactive to the active condition to supply electric power from battery (1) through self-holding circuit (5) to drive controller (2), validation sensor (4) and conveyer (3). After stacking device (41) stows valuable paper decided as genuine in accumulation chamber (44), drive controller (2) forwards a control signal to control terminal of shutoff circuit (7) to switch self-holding circuit (5) from the active to the inactive condition. Inactive condition of self-holding circuit (5) during the disuse period, saves electric power to extend service life and exchange cycle of battery (1). Also, once trigger element (6) is turned on to switch self-holding circuit (5) to the active condition, electric power is automatically supplied from battery (1) to drive controller (2) although trigger element (6) is turned off.

BEST MODE FOR CARRYING OUT THE INVENTION

Embodiments of the discriminating device according to the present invention are described hereinafter in connection with FIGS. 1 to 11 wherein the embodiments are applied to the bill validator shown in FIGS. 12 to 17. Same symbols in FIGS. 1 to 11 denote similar elements to those shown in FIGS. 12 to 17, and detailed explanation thereof is omitted.

Figure 1:
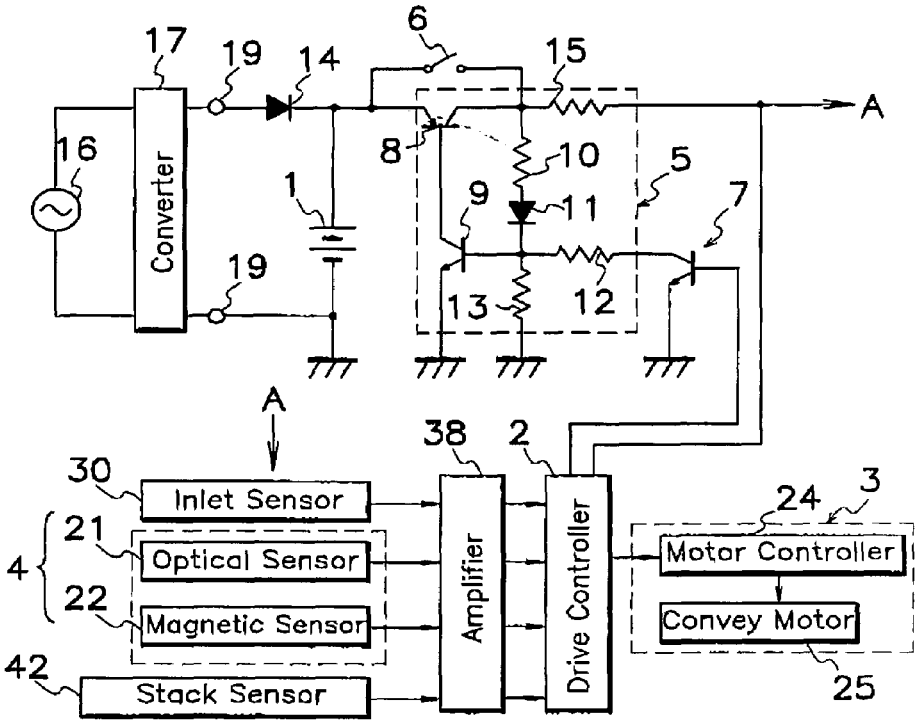
FIG. 1 is an electric circuit diagram for driving a bill validator according to the present invention.
Figure 2:
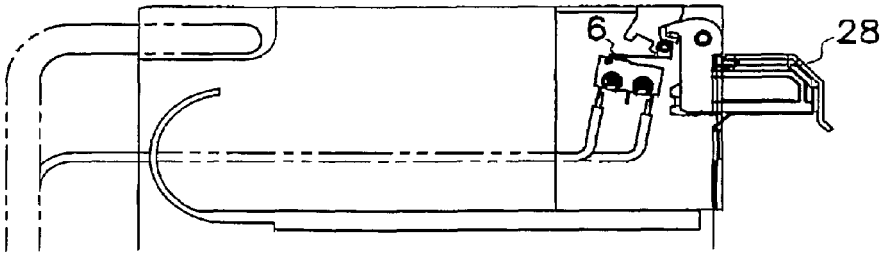
FIG. 2 is a section view of the bill validator according to the present invention with a cover closed.
Figure 3:
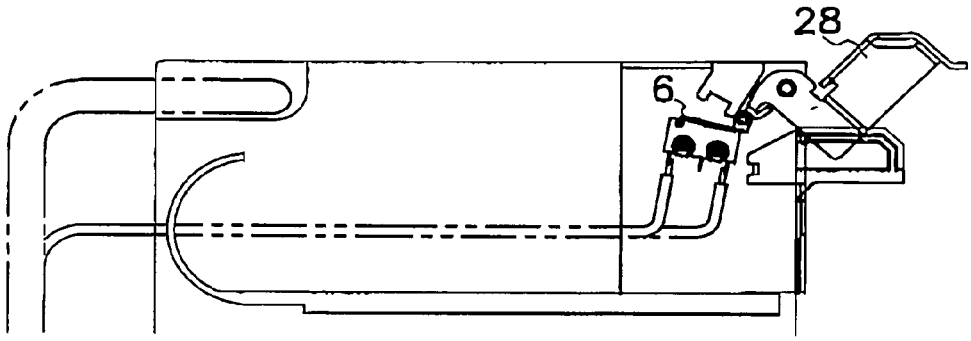
FIG. 3 is a sectional view of the bill validator shown in FIG. 2 but with the cover opened.
Figure 4:
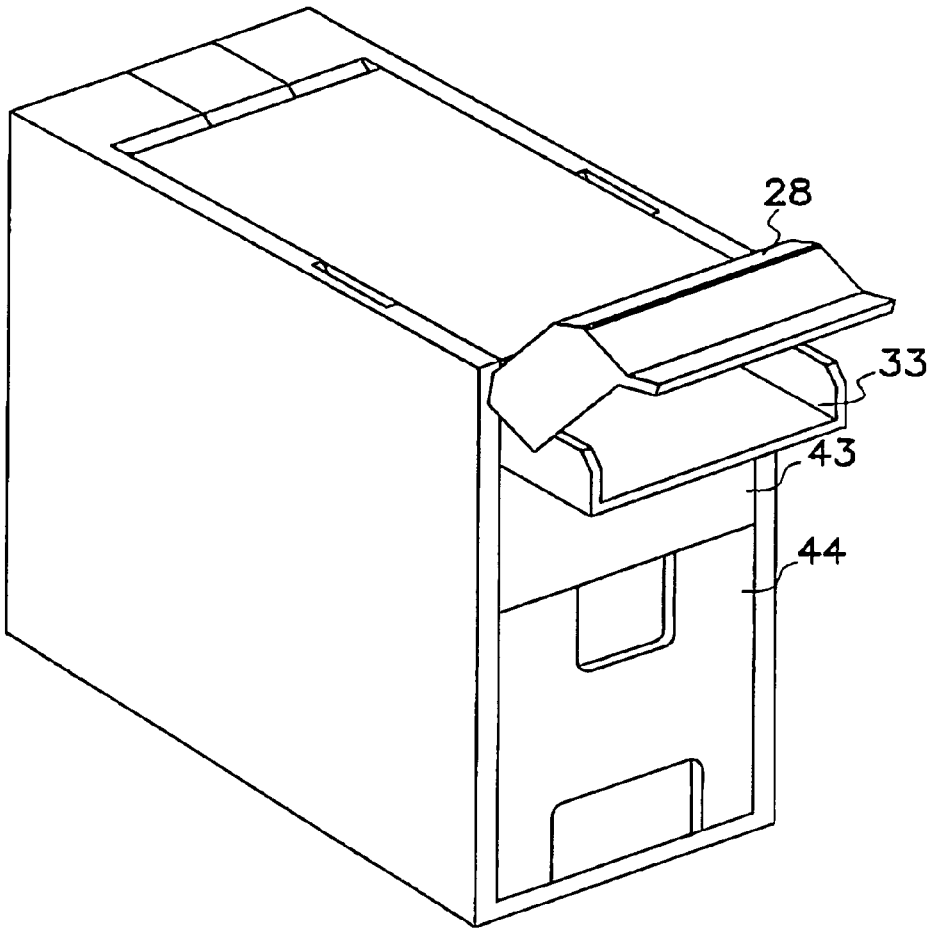
FIG. 4 is a perspective view of the bill validator according to the present invention.

As shown in FIG. 1, the bill validator according to the present invention comprises a battery 1; a self-holding circuit 5 connected between battery 1 and drive controller 2 and capable of being switched between an active condition for supplying electric power to validation sensor 4, drive controller 2 and conveyer 3 from battery 1 and an inactive condition for interrupting the power supply; a trigger element 6 for switching self-holding circuit 5 in the inactive condition to the active condition; a shutoff circuit 7 having a control terminal connected to drive controller 2 for switching self-holding circuit 5 in the active condition to the inactive condition; and a stack sensor 42 for detecting stacking operation of stacking device 41 for stowing a bill into accumulation chamber 44 to produce a stack signal. Trigger element 6 may for example include an automatic recovery switch which is turned on by opening operation of a cover 28 rotatably mounted adjacent to inlet 33 for receiving bill as shown in FIGS. 2, 3 and 4 or by pushing operation of a push button switch 29 shown in FIG. 7, and turned off by closing operation of cover 28 or by releasing pushing operation of push button switch 29. Not shown but, battery 1 is mounted in a frame for bill validator, and stack sensor 42 shown in FIG. 14 produces a detection signal to drive controller 2 when push plate 40 is returned to the original position after it stuffs bill into accumulation chamber 44. Inlet sensor 20, validation sensor 4 and stack sensor 42 are electrically connected through an amplifier 38 to corresponding input terminals of drive controller 2 which has an output terminal connected to a motor controller 24 of conveyer 3 for driving a convey motor 25 under control.

Self-holding circuit 5 comprises a first transistor 8 as a first switching element connected in series between battery 1 and drive controller 2, and in parallel to a trigger element 6; and a second transistor 9 as a second switching element connected to a base terminal of first transistor 8. Base terminal of second transistor 9 is connected to collector terminal of first transistor 8 and trigger element 6 through a series circuit of a resistor 10 and diode 11, and emitter terminal of first transistor 8 is connected to battery 1. Base terminal of second transistor 9 is connected through a resistor 13 to ground and through a resistor 12 to a collector terminal of a third transistor 7 as a shutoff circuit. Emitter terminal of third transistor 7 is grounded and base terminal thereof is connected to drive controller 2. Drive controller 2 is connected through a limiting resistor 15 to a collector terminal of first transistor 8. Battery 1 is connected to a converter 17 accommodated in frame of bill validator through a diode 14 and an outer terminal 19 to charge battery 1 with electric current flowing through converter 17 from commercial power source 16.

Figure 6:
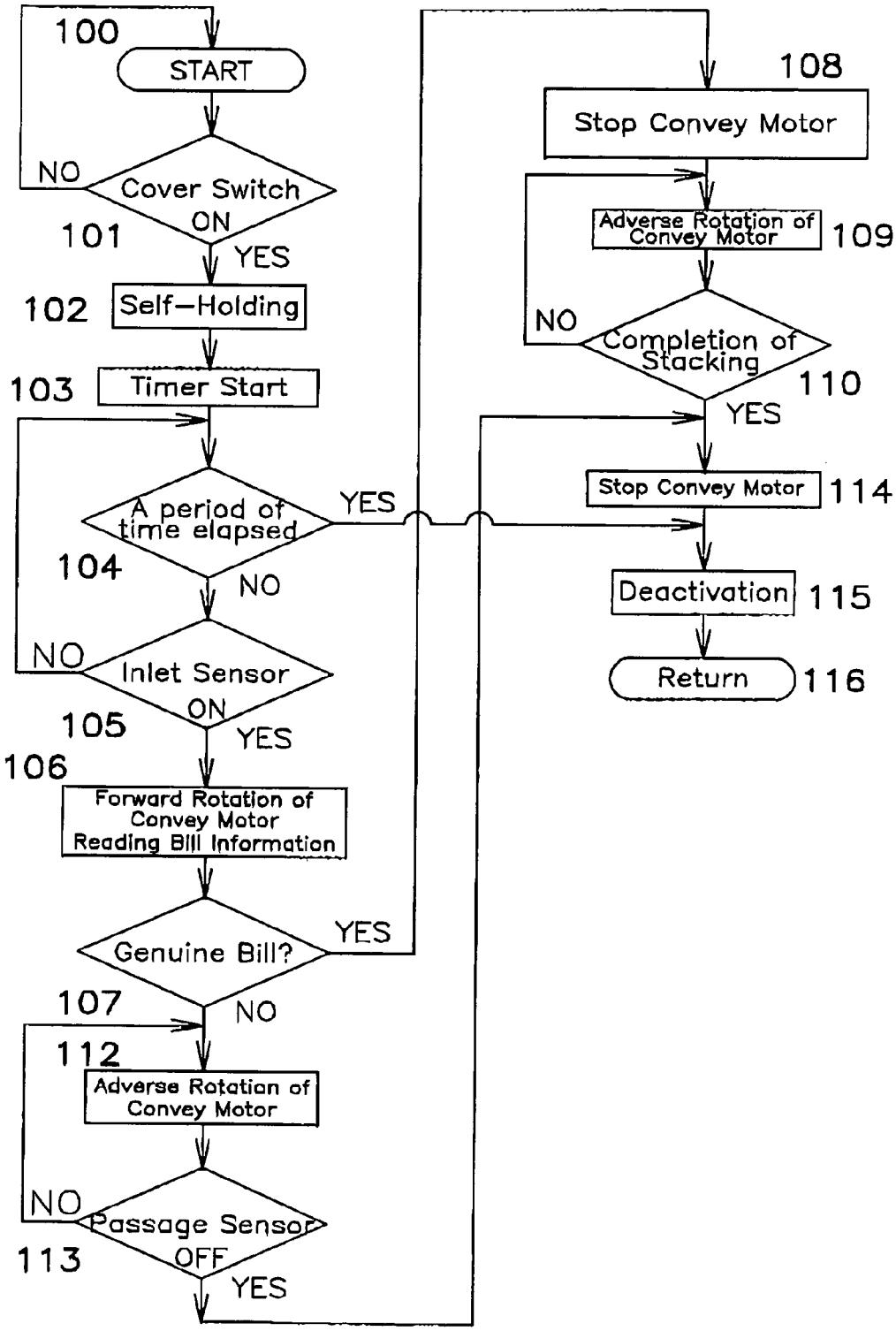
FIG. 6 is a flow chart showing an operational sequence of the bill validator according to the present invention.
Figure 7:
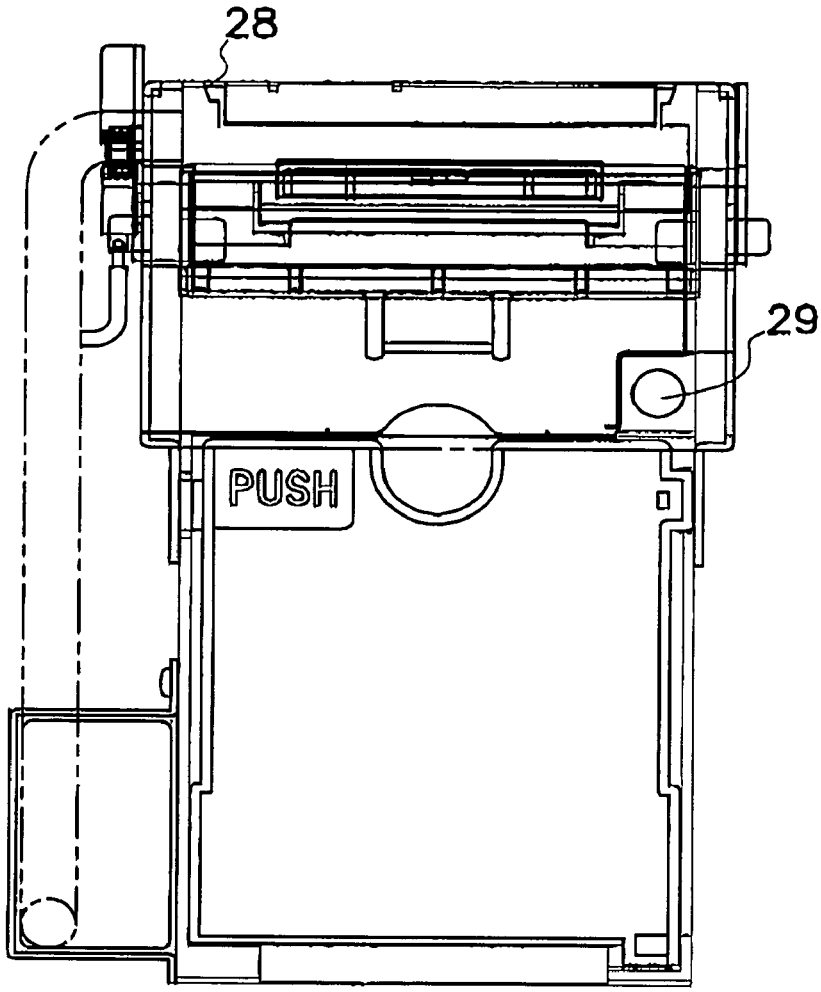
FIG. 7 is a front view of the bill validator according to the present invention.
Figure 8:
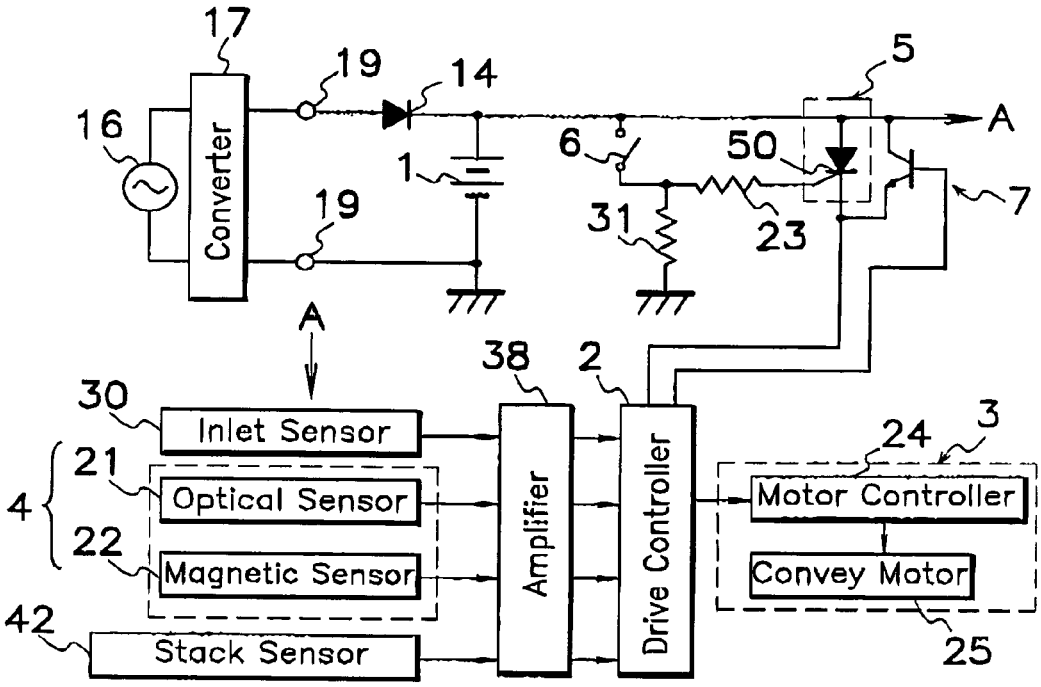
FIG. 8 is an electric circuit diagram showing a second embodiment of the invention.

Operation of the bill validator according to the present invention is described hereinafter in connection with a flow chart shown in FIG. 6.

When the processing for the bill validator moves from "START" in Step 100 to Step 101, the bill validator is in the inactive condition wherein both of trigger element 6 and first transistor 8 are in the off condition to interrupt power supply to any load, and therefore, there is no power consumption except dark current. When a cover 28 of FIG. 2 is rotated to open as shown in FIGS. 3 and 4, trigger element or cover switch 6 is turned on in Step 101 to pass electric current from charged battery 1 through trigger element 6, resistor 10 and diode 11 to base terminal of second transistor 9 which is thereby turned on. Accordingly, base terminal of first transistor 8 becomes on ground or zero voltage level to turn first transistor 8 on so that electric current flows from battery 1 through first transistor 8 to load and base terminal of second transistor 9. Thus, once trigger element 6 is turned on, second transistor 9 is retained on the conductive condition by electric current through first transistor 8, although trigger element 6 is switched off thereafter. This means that, once self-holding circuit 5 is switched from the inactive to the active condition, namely self-holding condition in Step 102, self-holding circuit 5 keeps the self-holding condition to continuously supply electric power from battery 1 to drive controller 2 and validation sensor 4 through self-holding circuit 5 although trigger element 6 is switched off thereafter. Then, in Step 103, a timer provided in drive controller 2 decides whether a predetermined period of time has elapsed since trigger element 6 is turned on. When the timer counts the passage of the predetermined period of time (Step 104), the processing moves to Step 115, and drive controller 2 provides a signal to base terminal of third transistor 7 as a control terminal of shutoff circuit. Therefore, third transistor 7 is turned on to turn second transistor 9 off because base terminal of second transistor 9 is grounded, and thereby first transistor 8 is turned off. Accordingly, self-holding circuit 5 is shifted from the active to the inactive condition to stop power consumption, and then, the process returns from Step 116 to Step 100.

Figure 5:
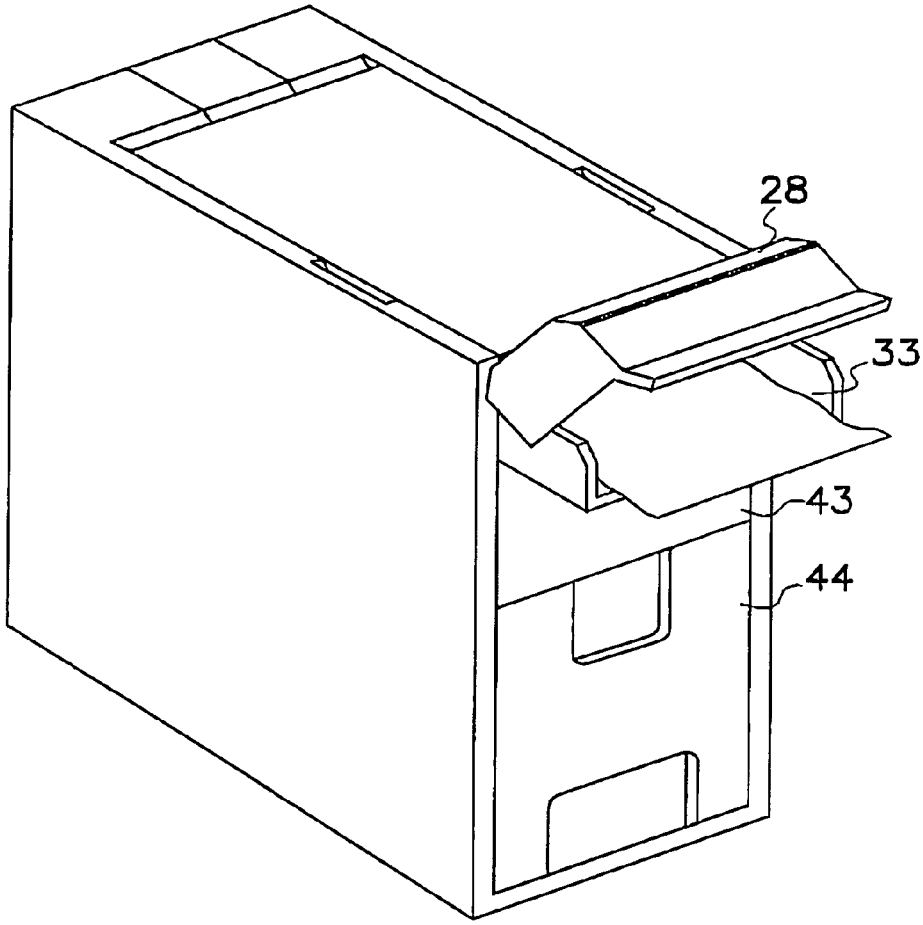
FIG. 5 is a perspective view showing a condition of a bill inserted into an inlet of the bill validator of FIG. 4.

When bill is inserted into inlet 33 as shown in FIG. 5 under the self-holding or conductive condition of self-holding circuit 5 before the timer counts passage of the predetermined period of time, inlet sensor 30 is turned on in Step 105 upon detection of inserted bill to produce a detection signal to drive controller 2. Accordingly, in Step 106, drive controller 2 sends drive signals to motor controller 24 to rotate convey motor 25 in the forward direction; drive belt 83 and convey belt 27 are driven to transport bill inwardly along passageway 34; bill is scanned by validation sensor 4 of optical and magnetic sensors 21 and 22 to perceive physical feature such as optical or magnetic feature of bill in order to read data from bill; and the data is forwarded to drive controller 2.

In Step 107, drive controller 2 decides based on the detected data whether bill is genuine or false. When drive controller 2 decides bill as genuine, it further rotates conveyer 3 in the forward direction to move bill toward the stand-by position 36. When bill is transported from arcuate path 35 to the stand-by position 36, bill overrides and rotates lever 46 against resilient force of tension spring 49, and a vending sensor (not shown) produces a vending signal to drive controller 2. When bill has thoroughly passed lever 46, and vending sensor has been turned off, bill reaches the stand-by position 36 above accumulation chamber 44 for storing bills and convey motor 25 is stopped (Step 108). Then, in Step 109, drive controller 2 rotates convey motor 25 in the adverse direction to move push plate 40 downward and stuff bill in the stand-by position into accumulation chamber with push plate 40. When stack sensor 42 (FIG. 14) produces a detection signal, drive controller 2 decides completion of stacking (in Step 110), and stops adverse rotation of convey motor 25 in Step 114; the processing moves to Step 115; drive controller 2 provides base terminal of third transistor 7 as a control terminal of shutoff circuit with a control signal to switch self-holding circuit 5 from the active to the inactive condition. Switching of self-holding circuit 5 to the inactive condition during the disuse period enables repression of power consumption from battery 1 and extends service life and exchange cycle of battery 1. Also, once trigger element 6 is turned on to switch self-holding circuit 5 to the active condition, electric power is automatically supplied from battery 1 to drive controller 2 although trigger element 6 is turned off. Then, the operation advances to Step 116.

When drive controller 2 cannot decide bill as genuine in Step 107, the processing moves from Step 107 to 112 wherein convey motor 25 is rotated in the reverse direction to travel bill toward inlet 33. After rear end of bill passes inlet sensor 30 in Step 113, drive controller 2 stops convey motor 25 in Step 114, and the action goes to Steps 115 and 116 wherein same treatments as mentioned above are done. In this way, the present invention, self-holding circuit 5 is shifted to the inactive condition to stop power consumption from battery during the nonuse period of bill validator, thereby extending exchange or charge time of battery 1 for a very long period of time. Also, once trigger element 6 is turned on to switch self-holding circuit 5 to the active condition, electric power can automatically be supplied to drive controller 2 from battery 1 even when trigger element 6 is turned off. For example, if battery 1 comprises a lead battery of 12 volts for two minutes active condition per one operation, the bill validator can attain more than 300 times operations free of exchange or charge.

Embodiments of the present invention can be varies in various ways without limitation to the foregoing embodiment. For example, as shown in FIG. 1, battery 1 can be charged by electric current supplied through a pair of outer terminals 19 to provide additional power source to drive controller 2, conveyer 3 or validation sensor 4. In addition, when charged electric amount in battery 1 is reduced, battery 1 can be charged with electric current flowing through a converter 17 and outer terminals 19 from commercial AC power source 16 for re-use or continuous use of battery 1. The present invention also contemplates direct power supply to the bill validator from AC power source 16 if battery cannot produce electric power. A rectifying diode 14 is provided between battery 1 and outer terminal 19 to prevent a back flow from battery 1 to outer terminals 19.

Figure 15:
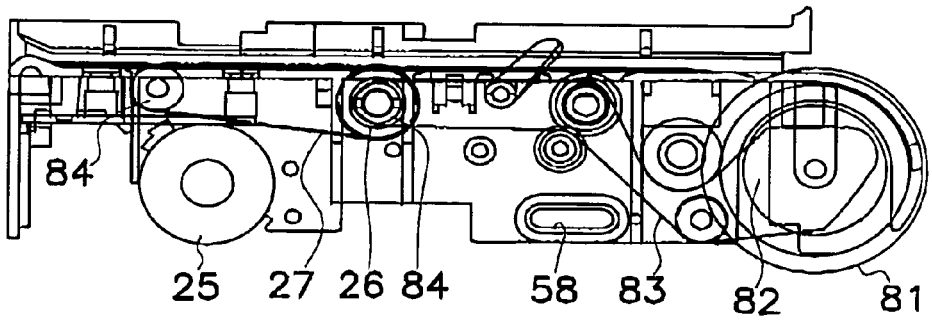
FIG. 15 Prior Art
FIG. 15 is a side elevation view showing a driving device.
Figure 16:
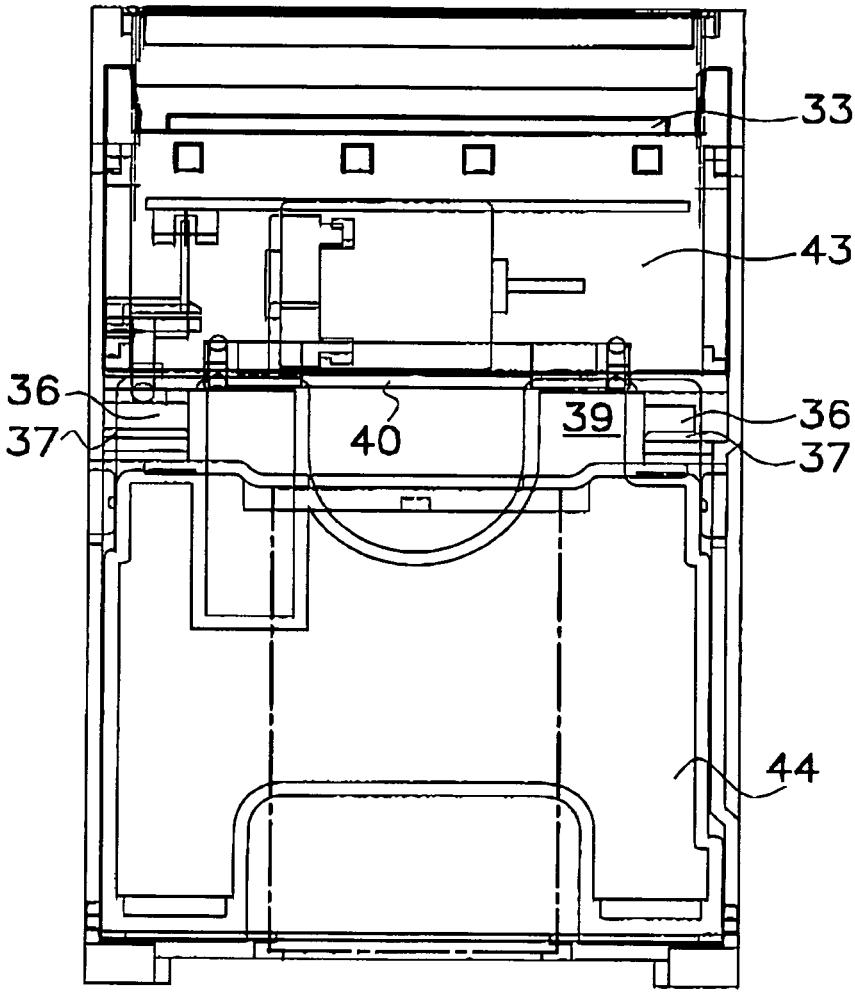
FIG. 16 Prior Art
FIG. 16 is a front view of the bill validator shown in FIG. 12.
Figure 17:
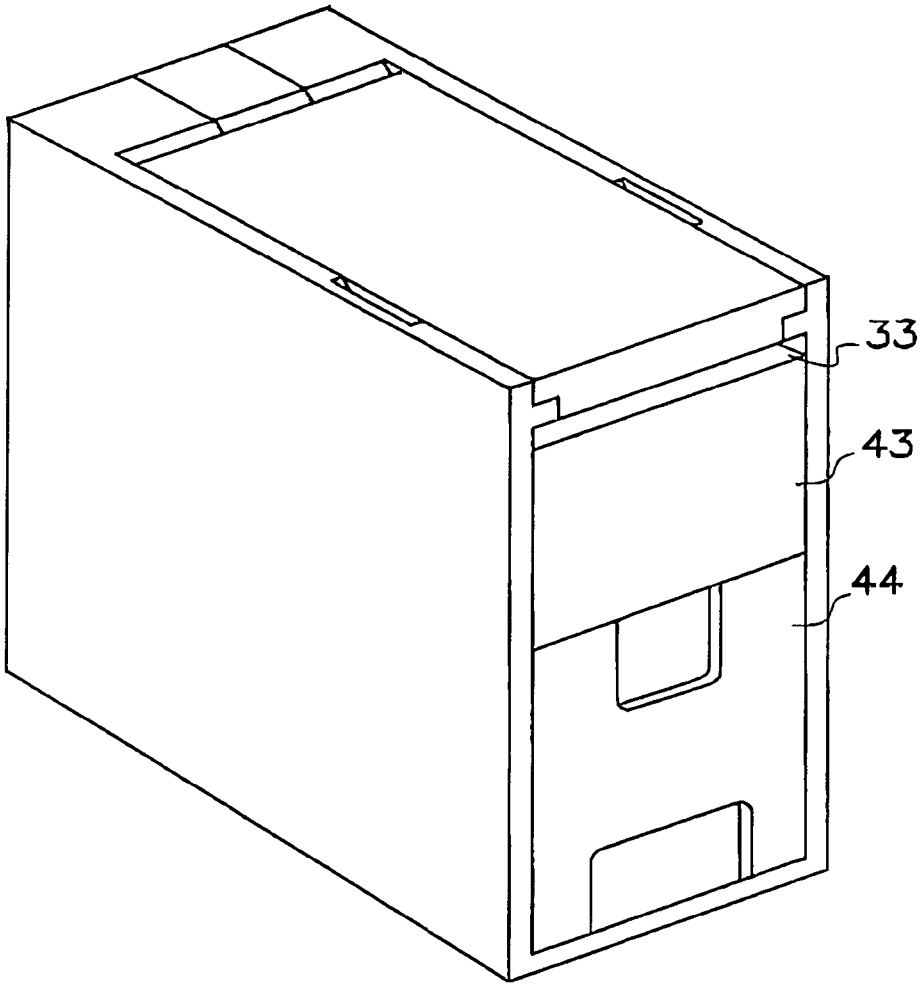
FIG. 17 Prior Art
FIG. 17 is a perspective view of the bill validator shown in FIG. 12.

In another embodiment shown in FIG. 15, self-holding circuit 5 comprises a thyristor 50 connected between battery 1 and drive controller 2. Trigger element 6 is connected to a gate terminal of thyristor 50 through a resistor 23 and to battery 1, and shutoff circuit 7 can be connected between two main terminals of thyristor 50. A junction between trigger element 6 and resistor 23 is grounded through a resistor 31. Like in the embodiment of FIG. 1, outer terminals 19 are connected to commercial AC power source 16 through converter 17 and rectifying diode 14 for reverse current protection to charge battery 1. Electric power may directly be supplied from AC power source 16 to the bill validator.

In operation of the bill validator shown in FIG. 15, cover 28 of FIG. 2 is opened as shown in FIGS. 3 and 4 to turn on cover switch 6 as trigger switch. Alternatively, push button 29 on front surface of the validator may be manually operated. When cover switch 6 is turned on, a control signal is given from battery 1 through cover switch 6 and resistor 23 to gate terminal of thyristor 50 to turn on between anode and cathode electrodes of thyristor 50. Accordingly, self-holding circuit 5 is shifted from the nonconductive to the conductive condition to supply electric power from battery 1 to drive controller 2. Subsequent operation is similar to that in the embodiment shown in FIG. 1 as above-mentioned. In addition, when drive controller 2 provides a control signal to a base terminal of PNP transistor 7 as a shutoff circuit, transistor 7 is turned on to stop thyristor 50 because anode and cathode electrodes of thyristor 50 are on the same voltage level to switch self-holding circuit 5 from the active to the inactive condition and stop the validator.

Trigger element 6 is connected between battery 1 and self-holding circuit 5 to switch self-holding circuit 5 from the inactive to the active condition. Trigger element 6 may be connected between emitter and collector terminals of PNP transistor 7 to directly and temporarily supply electric power to drive controller 2 which then shifts self-holding circuit 5 from the inactive to the active or self-holding condition. Also, trigger element 6 may be a push button 29 shown in FIG. 7 or infra-red ray sensor not shown for detecting human body.

Figure 9:
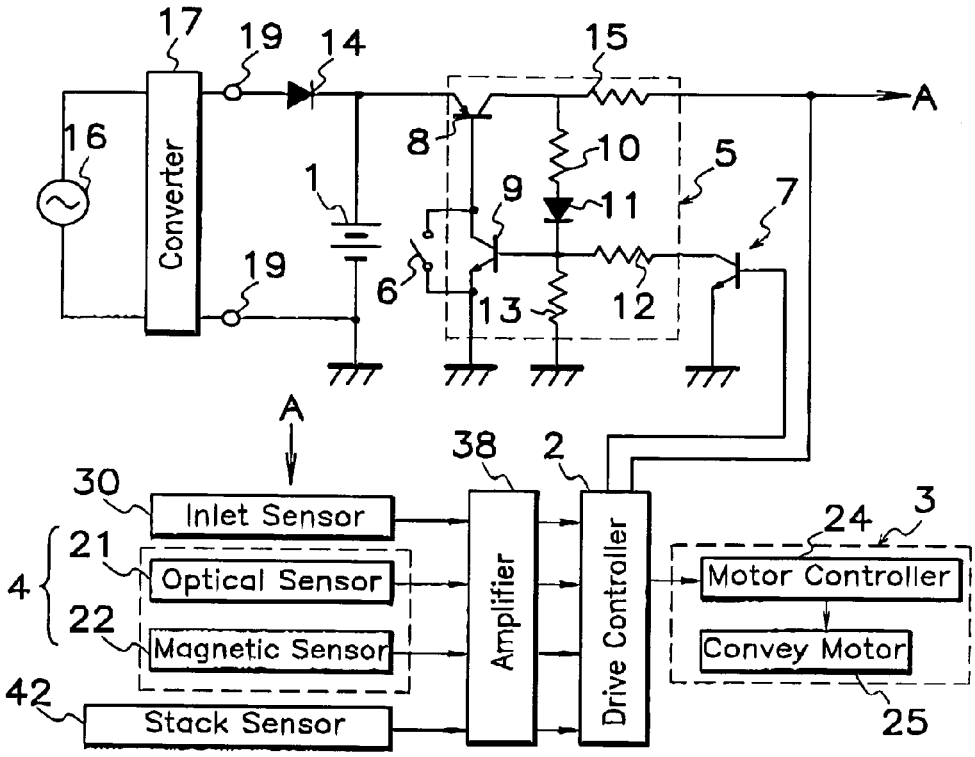
FIG. 9 is an electric circuit diagram showing a third embodiment of the invention.

As shown in FIG. 9, trigger element 6 may be connected between emitter and collector terminals of NPN transistor 9 as a second switching element for self-holding circuit 5. When trigger element 6 is turned on, base terminal of first transistor 8 is on the earth voltage level to turn first transistor 8 on so that electric current flows from battery 1 through self-holding circuit 5 in the conductive condition to the bill validator. Following operations of the validator are similar to those in the embodiment shown in FIG. 1.

Figure 10:
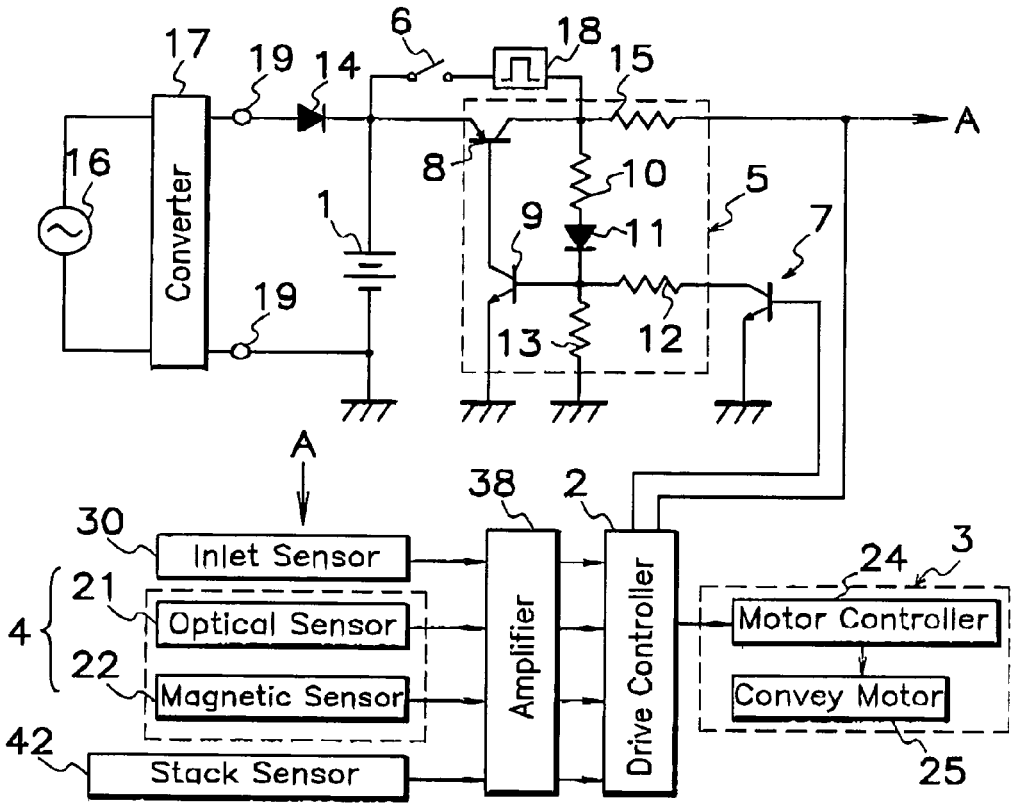
FIG. 10 is an electric circuit diagram showing a fourth embodiment of the invention.

As shown in FIG. 10, trigger element 6 may be connected between battery 1 and self-holding circuit 5 through a pulse generator 18 which may include a one-shot multivibrator or a differentiating circuit for generating a pulse signal of a given pulse width. Upon voltage rise of a signal from trigger element 6 turned on, pulse generator 18 produces a pulse to switch self-holding circuit 5 from the inactive to the active condition, and thereafter, pulse generator 18 does not produce any output although trigger element 6 is kept on.

Figure 11:
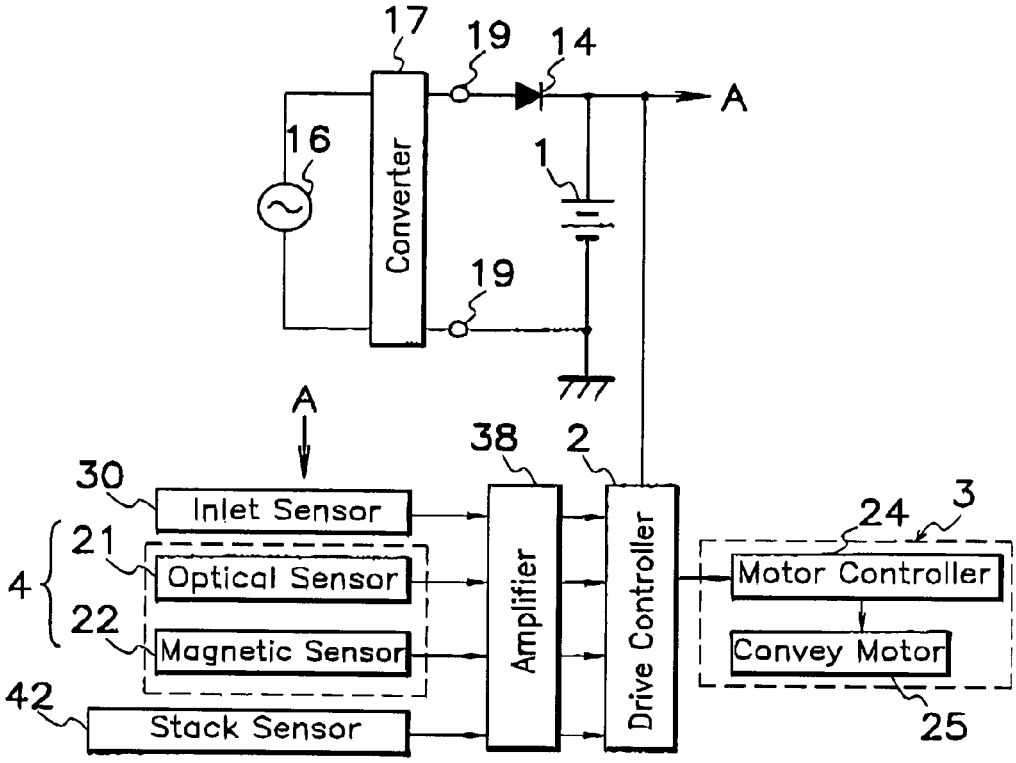
FIG. 11 is an electric circuit diagram showing a fifth embodiment of the invention.
Figure 12:
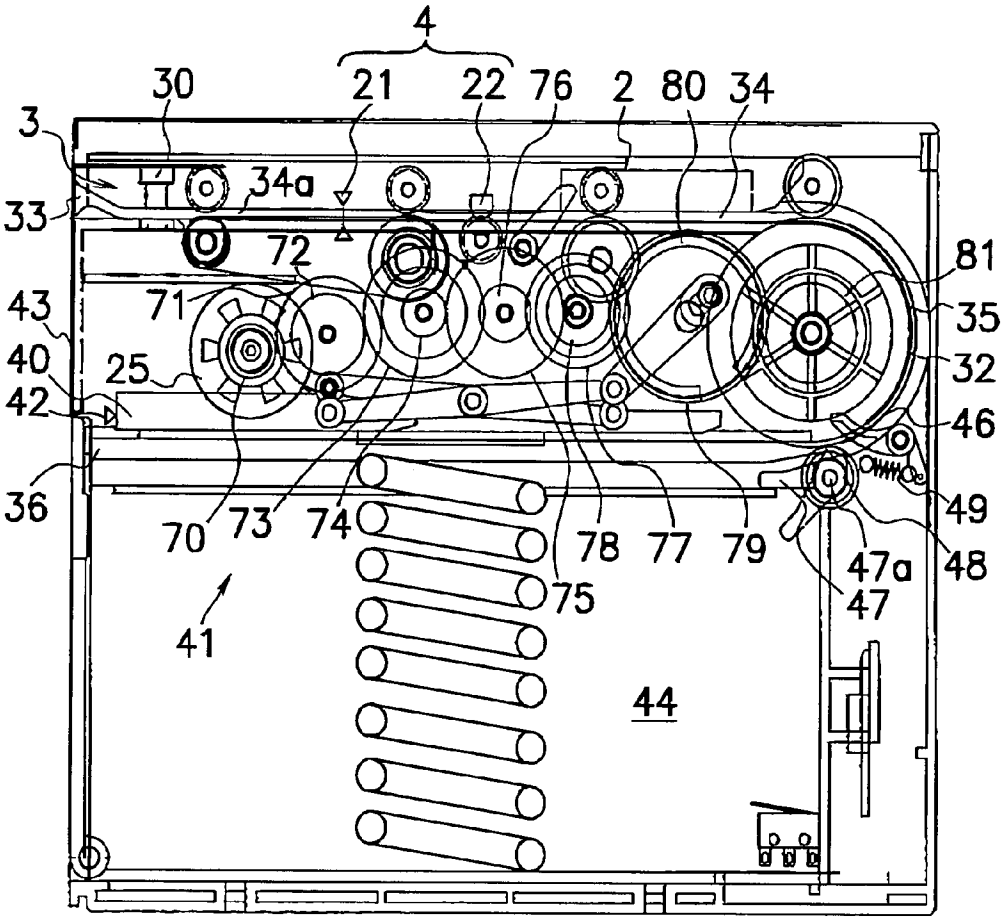
FIG. 12 Prior Art
FIG. 12 is a sectional view of a prior art bill validator.
Figure 13:
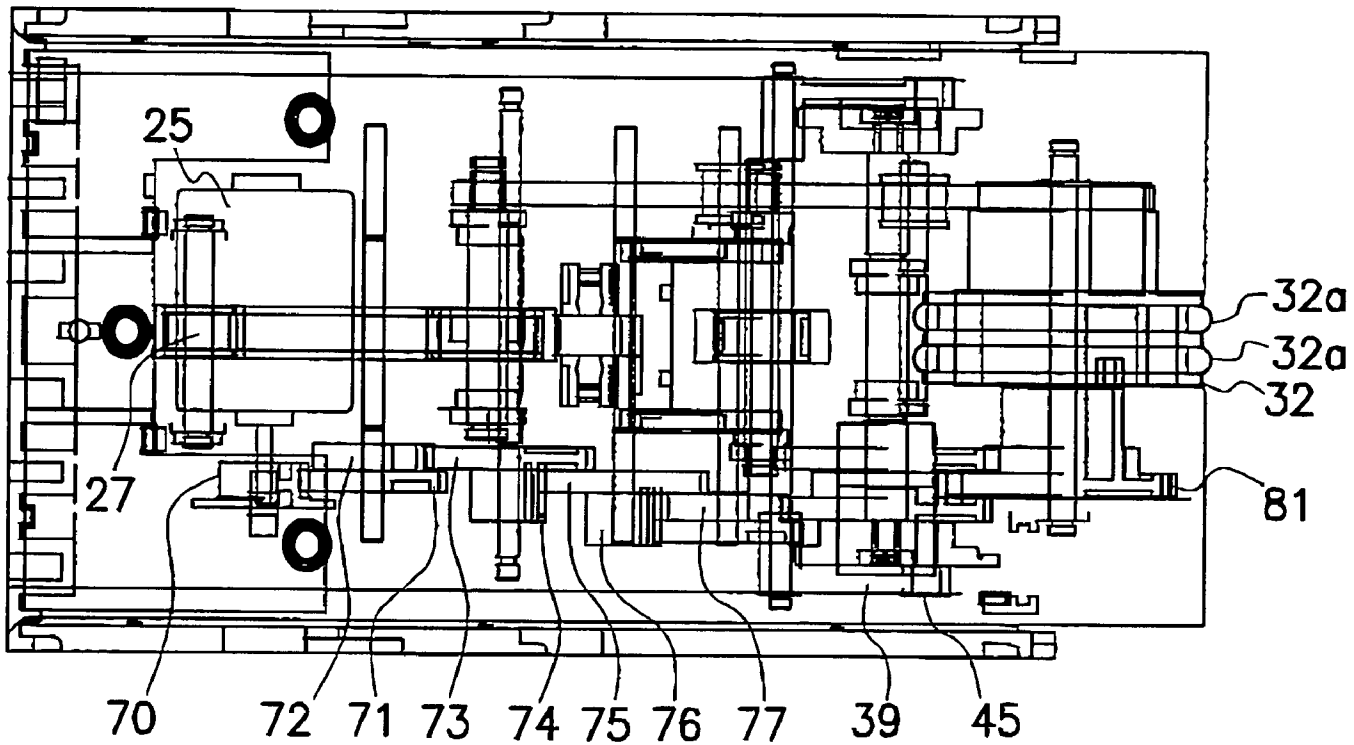
FIG. 13 Prior Art
FIG. 13 is a plan view of FIG. 12 but shown in section.
Figure 14:
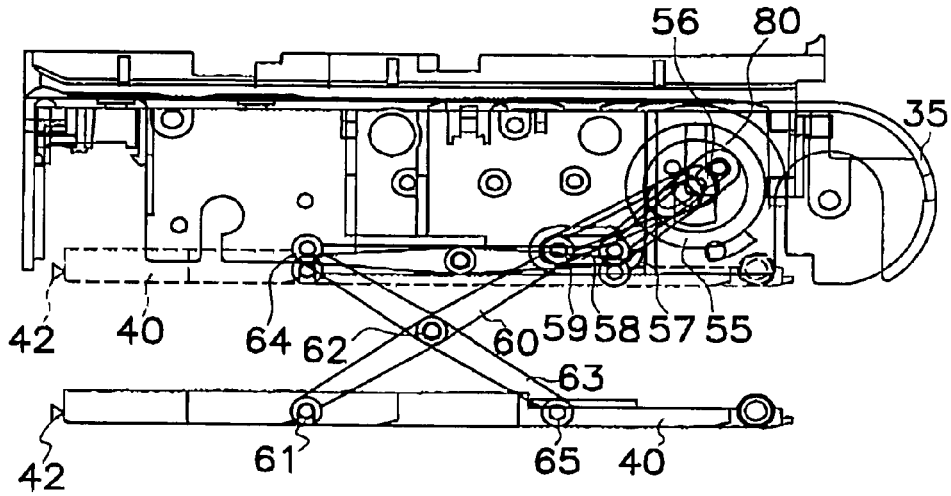
FIG. 14 Prior Art
FIG. 14 is a side elevation view of a stacking device with a push plate in the extended position.

FIG. 11 illustrates a further embodiment of the bill validator which has one-chip microcomputer integrally involving self-holding circuit 5 and drive controller 2. Not shown but the program-controlled microcomputer comprises a self-holding means capable of being switched between the active condition for supplying electric power to drive controller 2 and conveyer 3 and the inactive condition for shutting off the power supply; and a shutoff means for switching the self-holding means to the inactive condition. When trigger element 6 is turned on, an input terminal of drive controller 2 is grounded, and the self-holding means is shifted from the inactive to the active condition. While the foregoing embodiments refer to bill validators, it should be understood that the present invention can be applied to validation of coupons, bank notes, securities or other valuable papers.

Shutoff of power supply from battery to the device for discriminating valuable papers during the disuse period can accomplish restriction of power consumption and power-saving from battery, extending service life of battery for a very long period of time.

INDUSTRIAL APPLICABILITY

The device for discriminating valuable papers according to the present invention can be mounted various kinds of bill handling apparatus such as vending machines, bill exchangers, cash dispensers etc.

What is claimed is:

1. A device for discriminating valuable papers comprising:

a conveyer for transporting a valuable paper inserted from an inlet along a passageway to a stand-by position of the passageway;

a validation sensor for detecting an optical or a magnetic pattern of the paper moving through the passageway to produce detection signals;

a stacking device for stowing the paper in the stand-by position into an accumulation chamber;

a trigger element connected to a battery and turned on by an opening operation of a cover mounted adjacent to the inlet;

a drive controller for receiving detection signals from the validation sensor, validating the authenticity of the paper and providing the conveyer and stacking device with drive signals, said drive controller comprising a timer for counting time elapse since the trigger element is turned on;

a self-holding circuit connected between the battery and drive controller and switched from an inactive to an active condition when the trigger element is turned on to supply electric power from the battery through the self-holding circuit to the drive controller, validation sensor and conveyer;

a shutoff circuit which has a control terminal for receiving a control signal from the drive controller to switch the self-holding circuit in the active to the inactive condition and thereby interrupt the power supply through the self-holding circuit; and a stack sensor for detecting stowage of the paper into the accumulation chamber in the stacking device to produce a detection signal to the drive controller;

wherein the drive controller is further operated to:

i) rotate the conveyer in the forward direction to transport the paper to the stand-by position, when the drive controller decides the paper inserted from the inlet is genuine;

ii) provide the control signal for the shutoff circuit to switch the self-holding circuit from the active to the inactive condition, when the drive controller receives a detection signal from the stack sensor;

iii) rotate the conveyer in the adverse direction to return the paper to the inlet, when the drive controller does not decide the paper inserted from the inlet is genuine; and iv) switch the self-holding circuit from the active to the inactive condition, when the timer has counted a predetermined period of time.

2. The device of claim 1, further comprising:

an inlet sensor for detecting insertion of the paper, wherein electric power is supplied to the inlet sensor and drive controller after the self-holding circuit is switched to the active condition; and wherein the drive controller drives the conveyer to transport the paper along the passageway after the self-holding circuit is switched to the active condition.

3. The device of claim 1, wherein the self-holding circuit comprises:

a first switching element connected in series between the battery and drive controller and in parallel to the trigger element; and a second switching element connected to a control terminal of the first switching element;

wherein a control terminal of the second switching element is connected to the trigger element and shutoff circuit.

4. The device of claim 1, wherein the self-holding circuit comprises a thyristor; the trigger element is connected to a gate terminal of the thyristor; and the shutoff circuit is connected to two main terminals of the thyristor.

5. The device of claim 1, wherein the trigger element comprises an automatic resetting switch or infrared ray sensor for detecting a human body.

6. The device of claim 1, wherein the battery can be electrically charged by electric current supplied through outer terminals and a converter connected to an AC power source.

7. The device of claim 1, wherein the trigger element comprises a pulse generator for producing a pulse to switch the self-holding circuit from the inactive to the active condition when the trigger element is turned on.

8. The device of claim 1, wherein there is no power consumption except dark current when the trigger element is in the off condition.

* * * * *